US006939162B2

(12) United States Patent
Park

(10) Patent No.: US 6,939,162 B2
(45) Date of Patent: Sep. 6, 2005

(54) ELECTRICAL CONNECTOR AND LIQUID CRYSTAL DISPLAY DEVICE EMPLOYING THE SAME

(75) Inventor: Hyun-Woo Park, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/735,161

(22) Filed: Dec. 12, 2003

(65) Prior Publication Data

US 2004/0209510 A1 Oct. 21, 2004

(30) Foreign Application Priority Data

Apr. 16, 2003 (KR) ..... 10-2003-0024089

(51) Int. Cl.[7] ..... H01R 13/629
(52) U.S. Cl. ..... 439/378; 439/374
(58) Field of Search ..... 439/378, 374, 439/247, 248, 328; 128/630, 897; 385/88

(56) References Cited

U.S. PATENT DOCUMENTS 5,193,069 A * 3/1993 Furuya ..... 361/681
5,466,171 A * 11/1995 Bixler et al. ..... 439/378
5,486,124 A * 1/1996 Wandler ..... 439/843
5,605,150 A * 2/1997 Radons et al. ..... 600/300
5,980,273 A * 11/1999 Yong et al. ..... 439/79

* cited by examiner

*Primary Examiner*—Alexander Gilman
(74) *Attorney, Agent, or Firm*—Cantor Colburn LLP

(57) ABSTRACT

A connector includes a first connection part having connection pins electrically connected with a driving module, a supporting body for holding the connection pins, and a guide body extended from a end of the supporting body, which has a guide groove formed at an inner face of the guide body, and a second connection part having connection slots for receiving the connection pins to provide electrical connection between the connection pins and an external device, a side face extended from a front face of the second connection part, a guide step formed on the side face to be inserted into the guide groove, and a warpage preventing protrusion formed on the guide step to prevent the connection pins from being bent at the time of detaching the first connection part from the second connection part. The connector may also include chamfers each formed at an inner corner of an edge of the guide body, and a warpage preventing opening formed at a corner at which the side face, the front face and the guide step meet each other.

41 Claims, 12 Drawing Sheets

ELECTRICAL CONNECTOR AND LIQUID CRYSTAL DISPLAY DEVICE EMPLOYING THE SAME

BACKGROUND OF THE INVENTION

1. Field of the Invention

The present invention relates to an electrical connector, and more particularly to an electrical connector designed to prevent its connection pins from being warped, and to an image display device employing such an electrical connector.

2. Description of the Related Art

Generally, image display devices, such as liquid crystal display devices, employ one or more connectors for providing electrical connection between a main board and an image display module for displaying images thereon. Such connector usually has first and second parts to be combined with and detached from each other. One of the first and second parts of the connector transfers electric signals from a main board to the other.

In case that the first part of a connector is connected to the image display module and the second part is connected to the main board, the first part usually has mounting pins, connection pins and a mold frame for holding and protecting a connection portion between the mounting and connection pins. Also, the connecting pins are inserted into the second part of the connector.

The second part of the connector has connection slots each having a connection terminal therein. The connection terminals are connected with external signal lines, so that electrical signals provided through the signal lines are transferred through the connection terminals to the connection pins of the first part of the connector.

Since image display devices are trending to having a smaller and thinner size and lighter weight, connectors employed in such image display devices become smaller and thinner as well. In case that a connector having the above mentioned first and second parts has a smaller and thinner size, it is difficult to separate the first part from the second part and vice versa by applying a uniform force onto the ends of either of or both the first and second parts of the connector. In this case, thus, the first and second parts of the connector are usually separated by applying torque onto the first and/or second parts. In other words, when the first and second parts of the connector are detached from each other, a stronger force is applied onto a first end portion of the connector (i.e., first end portion(s) of the first and/or second part(s)) than onto a second end portion of the connector (i.e., second end portion(s) of the first and/or second part(s)) to extract the connection pins adjacent to the first end of the connector. Then, the connection pins adjacent to the second end portion of the connector are extracted by applying another force onto the second end portion of the connector.

As a result, the connection pins adjacent to the second end portion of the connector are warped because they remain in the connection slots while the connection pins adjacent to the first end portion of the connector has exited from the connection slots. Since the connection pins remaining in the connection slots can hardly maintain on the straight, they are apt to be warped or bent. Such warpage of the connection pins causes problems such as misalignment of the connection pins with the connection slots and deterioration in electrical connection between the first and second parts of the connector.

Therefore, a need exists for an electrical connector that provides safe electric connection between the first and second parts of the connector by preventing the connection pins of the connector from being warped or bent at the time of separating the first and second parts from each other. Further, it will be advantageous to provide an image display device employing such electric connector for transferring electric signals between a main board and a display module.

SUMMARY OF THE INVENTION

The above discussed and other drawbacks and deficiencies of the prior art are overcome or alleviated by the enhanced performance telecommunications connector of the present invention.

In one embodiment, a connector for electrically connecting first data lines to second data lines, comprising a first connection part that includes connection pins electrically connected with the first data lines, a supporting body for holding the connection pins, and a guide body extended from a first longitudinal end of the supporting body in a direction substantially perpendicular to a longitudinal direction of the supporting body, in which the guide body has a guide groove formed at an inner face of the guide body, and a second connection part that includes connection slots for receiving the connection pins to provide electrical connection between the first data lines and the second data lines, in which the connection slots each has an entrance hole at a front face of the second connection part, a side face extended from the front face in a direction substantially perpendicular to a longitudinal direction of the front face, a guide step formed on the side face to be inserted into the guide groove, and a warpage preventing protrusion formed on the guide step to prevent the connection pins from being bent at the time of detaching the first connection part from the second connection part.

The guide body may include a first guide body portion to be in contact with the side face when the first and second connection parts are combined, and a second guide body portion to be in contact with the guide step when the first and second connection parts are combined, wherein the first and second guide body portions form side walls of the guide groove.

In another embodiment, the guide body may have a chamfer formed at an inner corner of an edge opposite to the supporting body. The chamfer is in contact with the side face and the guide step when the first connection part is rotated to be detached from the second connection part. The second connection part may also include a warpage preventing opening formed at a corner at which the side face, the front face and the guide step meet each other. The warpage preventing opening is extended from a connection slot adjacent to the side face.

In still another embodiment, a liquid crystal display device includes a liquid crystal display panel for processing image data signals to display images by controlling liquid crystal disposed in the liquid crystal display panel, a driving module for providing the liquid crystal display panel with driving signals to control the liquid crystal in the liquid crystal display panel, and a connector for providing electrical connection between the driving module and an external device, in which the connector includes the above mentioned features.

These and other objects, features and advantages of the present invention will become apparent from the following detailed description of the exemplary embodiments thereof, which is to be read in conjunction with the accompanying drawings.

BRIEF DESCRIPTION OF THE DRAWINGS

This disclosure will present in detail the following description of exemplary embodiments with reference to the following figures wherein.

DETAILED DESCRIPTION OF THE INVENTION

Detailed illustrative embodiments of the present invention are disclosed herein. However, specific structural and functional details disclosed herein are merely representative for purposes of describing exemplary embodiments of the present invention.

Figure 1A:
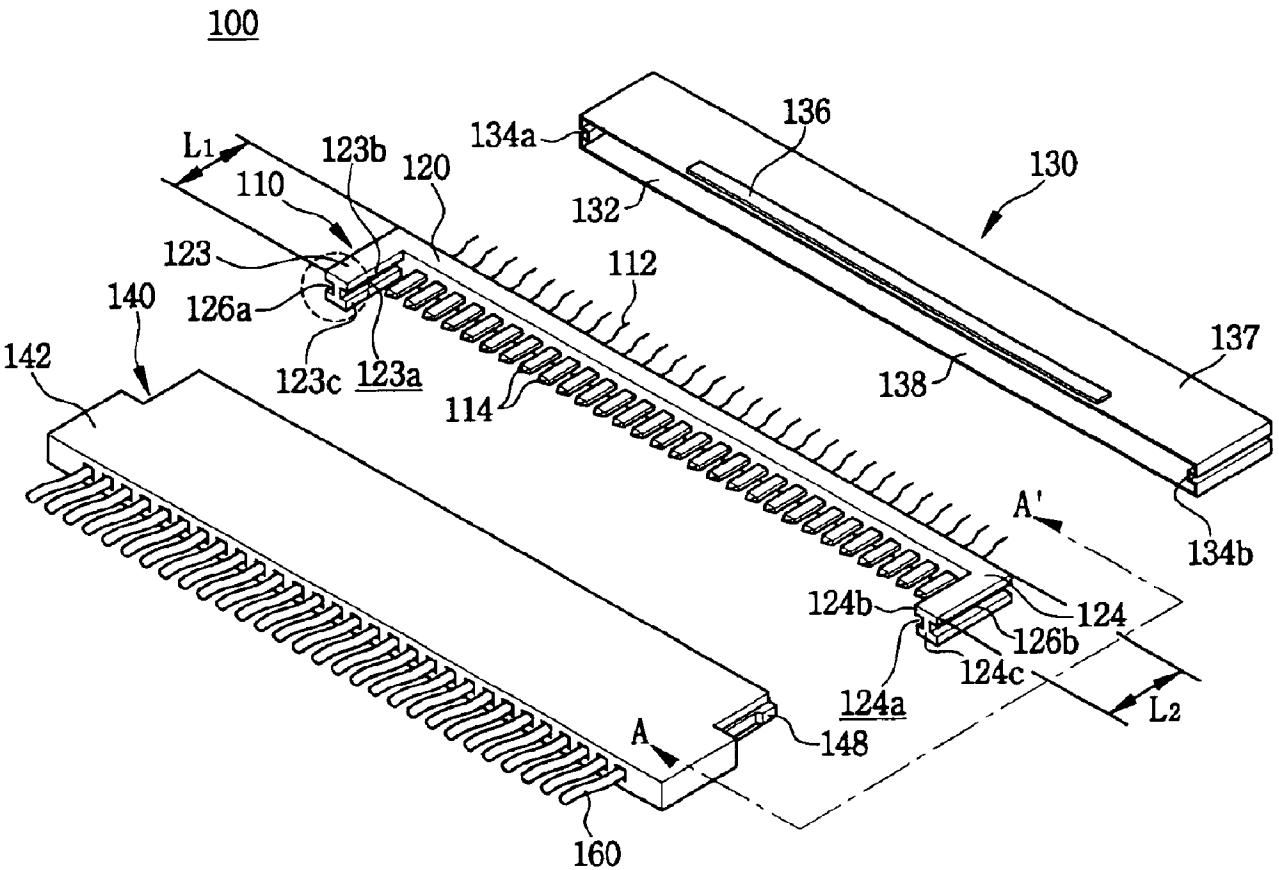
FIG. 1A is an exploded perspective view illustrating a connector according to an exemplary embodiment of the present invention.

FIG. 1A is an exploded perspective view showing a connector according to an exemplary embodiment of the present invention. The connector 100 includes a first connection part 110 and a second connection part 140 to be detachably combined with each other. The connector 100 also includes a cover 130 for receiving the first connection part 110.

The first connection part 110 has a supporting body 120 and first and second guide bodies 123, 124 that are extended from first and second end portions, respectively, of the supporting body 120. The supporting body 120 holds mounting pins 112 and connection pins 114 such that the mounting pins 112 are disposed at one side of the supporting body 120 and the connection pins 114 are disposed at the opposite side of the supporting body 120. The mounting and connection pins 112, 114 are electrically connected with each other. In other words, each of the mounting pins 112 is electrically connected with corresponding one of the connection pins 114. The other ends of the mounting pins 112, opposite to the ends mounted in the supporting body 120, may be mounted at a printed circuit board of an image display device such as a liquid crystal display (LCD) device.

The connection pins 112 are apart from each other at a regular distance and also parallel to each other. The supporting body 120 holding the mounting and connection pins 112, 114 has a bar shape having a longitudinal direction and a widthwise direction. In the supporting body 120, for example, corresponding ones of the mounting and connection pins 112, 114 are connected with each other.

The first and second guide bodies 123, 124 are extended from the first and second end portions, respectively, of the supporting body 120 in a direction substantially parallel with the longitudinal direction of the connection pins 114 and substantially perpendicular to the longitudinal direction of the supporting body 120.

Figure 1B:
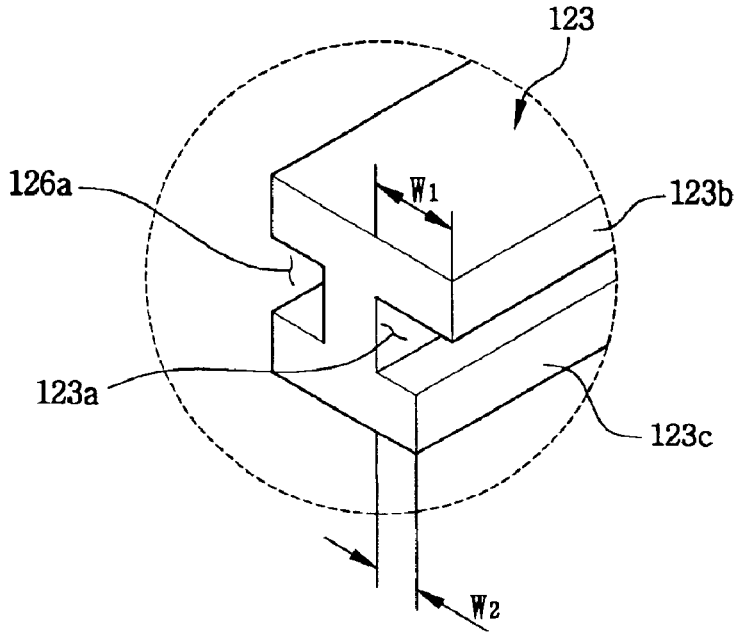
FIG. 1B is an enlarged view of the guide body in FIG. 1A.

FIG. 1B is an enlarged view of the first guide body 123 in FIG. 1A. It is noted that the second guide body 124 has the substantially same structure as that of the first guide body 123. The guide body 123 has a guide groove 123*a*, a first guide body portion 123*b*, and a second guide body portion 123*c*. The guide groove 123*a* is formed at an inner face of the guide body 123, which faces the connection pins 114, in the longitudinal direction of the guide body 123. The first and second guide body portions 123*b*, 123*c* form side walls of the guide groove 123*a*. The guide body 123 also has a connection groove 126*a* formed at an outer face of the guide body 123, which is the opposite side of the inner face, in the longitudinal direction of the guide body 123.

The first and second guide body portions 123*b*, 123*c* have first and second widths $W_1$, $W_2$, respectively, different from each other. For example, the width of the first guide body portion 123*b* is larger than that of the second guide body portion 123*c*. This is to prevent a wrong connection between the first and second connection parts 110, 140. In other words, by making the widths of the first and second guide body portions 123*b*, 123*c* different from each other, the first and second guide bodies 123, 124 of the first connection part 110 are each connected to its corresponding part of the second connection part 140.

Referring again to FIG. 1, the second guide body 124 also has a guide groove 124*a*, first and second guide body portions 124*b*, 124*c*, and a connection grove 126*b* in like manner as those of the first guide body 123. The guide grooves 123*a*, 124*a* of the first and second guide bodies 123, 124 are formed at their inner faces, respectively, to face each other.

The first and second guide bodies 123, 124 each have a predetermined length, and the length of the first guide body 123 is different from that of the second guide body 124. This is also to prevent a wrong connection between the first and second connection parts 110, 140. This will be described in detail.

The cover 130 is made of a thin plate that is bent to form a receiving space 132 to receive the first connection part 110. The cover 130 has first and second connection members 134*a*, 134*b* at its first and second side faces, respectively. The first and second connection members 134*a*, 134*b* are each inwardly protruded toward the receiving space 132, so that they are combined with the connection grooves 126*a*, 126*b* of the first and second connection parts 120, 140, respectively. In other words, the first and second connection members 134*a*, 134*b* are slidely inserted into the first and second connection grooves 126*a*, 126*b*, respectively. As a result, the first connection part 110 is securely received in the cover 130.

The cover 130 may also have a reinforcing member 136 on either of or both the upper and lower faces 137, 138. The reinforcing member 136 is extended in a longitudinal direction of the cover 130 to prevent the cover 130 from being bent or damaged. The reinforcing member 136 may be formed through a press process.

Figure 2:
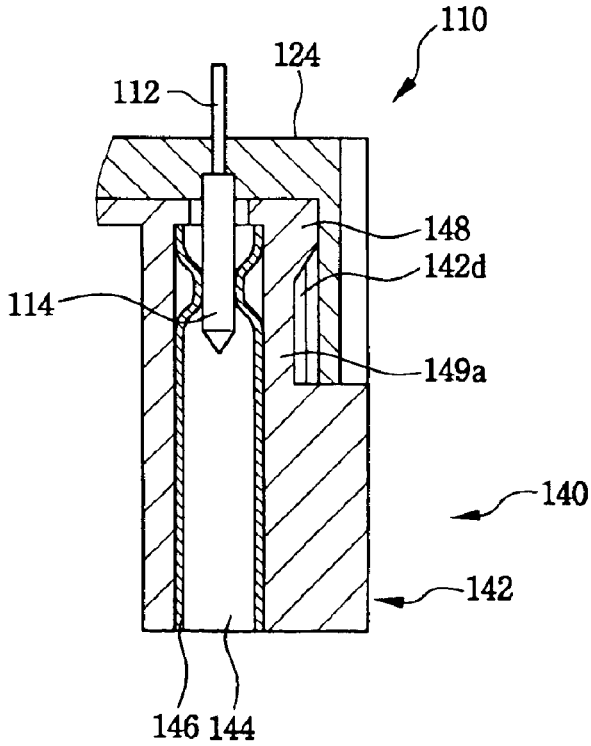
FIG. 2 is a partial cross-sectional view of the connector taken along line A–A' in FIG. 1A.
Figure 3:
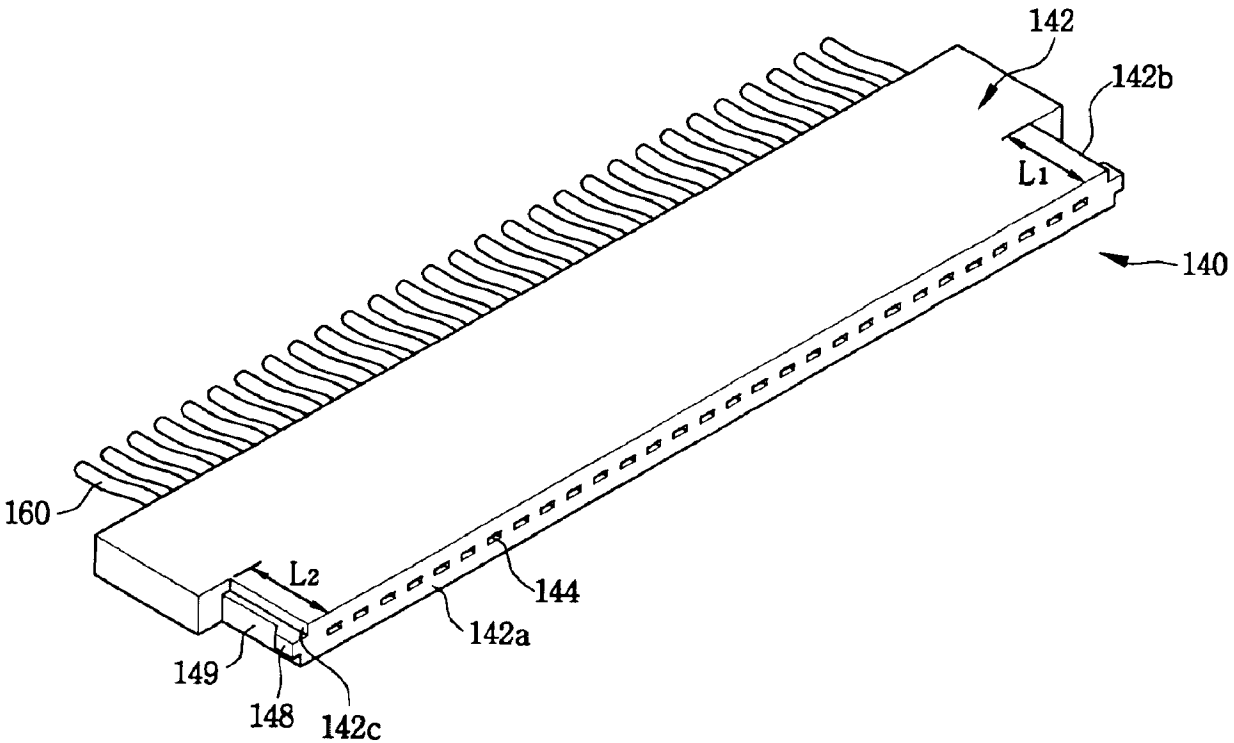
FIG. 3 is a perspective view illustrating the second connector in FIG. 1.

FIG. 2 is a cross-sectional view of the connector taken along line A–A' in FIG. 1A, and FIG. 3 is a perspective view of the second connection part in FIG. 1A. Referring to FIGS. 2 and 3, the second connection part 140 includes a receiving body 142 having front face 142*a* and side faces 142*b*, 142*c*. The second connection part 140 also has connection slots 144 formed in the receiving body 142, which are extended in the same direction as that of the connection pins 114 of the first connection part 110. The connection slots 144 each have an entrance hole formed at the front face of the receiving body 142. For example, a diameter of the entrance holes is smaller than that of the inner portions of the connection slots 144. The front face is in contact with the inner face of the supporting body 120 when the first and second connection parts 110, 140 are combined.

The receiving body 142 holds signal lines 160 at the side opposite to the front face. The connection slots 144 are extended to be in contact with the signal lines 160. In each of the connection slots 144, a connection terminal 146 is disposed to provide electric connection between the connection pins 114 inserted into the connection slots 144 and the signal lines 160. As shown in FIG. 2, each connection terminal 146 has a fixing portion for securely gripping the corresponding connection pin 114 inserted into the corresponding connection slot 144. The fixing portion has a diameter smaller than that of the remaining part of the connection terminal 146. The fixing portion having elasticity holds the connection pin 114 inserted into the connection slot 144 by pressing the connection pin 114 with recessed portions of the connection terminal 146.

The second connection part 140 also has a guide step 149 formed on each of the side faces 142*a*, 142*b* and a warpage preventing protrusion 148 formed on the guide step 149. The guide step 149 has a width smaller than that of the side face 142*c* and a length substantially same as that of the side face 142*c*. The widthwise center of the guide step 149 is offset from the widthwise center of the side face 142*c*, so that the side face 142*c* and the guide step 149 are in contact with the first and second guide body portions 123*b* 123*c*, respectively, when the first and second connection parts 110, 140 are combined with each other. In this embodiment, the guide step 149 has a height measured from the surface of the side face 142*c*, which is substantially same as the difference between the widths of the first and second guide body portions 123*b*, 123*c*. Also, since the first and second guide bodies 123, 124 have different lengths, the first and second side faces 142*b*, 142*c* have first and second lengths $l_1$, $l_2$ that are different from each other. The lengths of the first and second side faces 142*b*, 142*c* are substantially same as those of the first and second guide bodies 123, 124, respectively.

Figure 4:
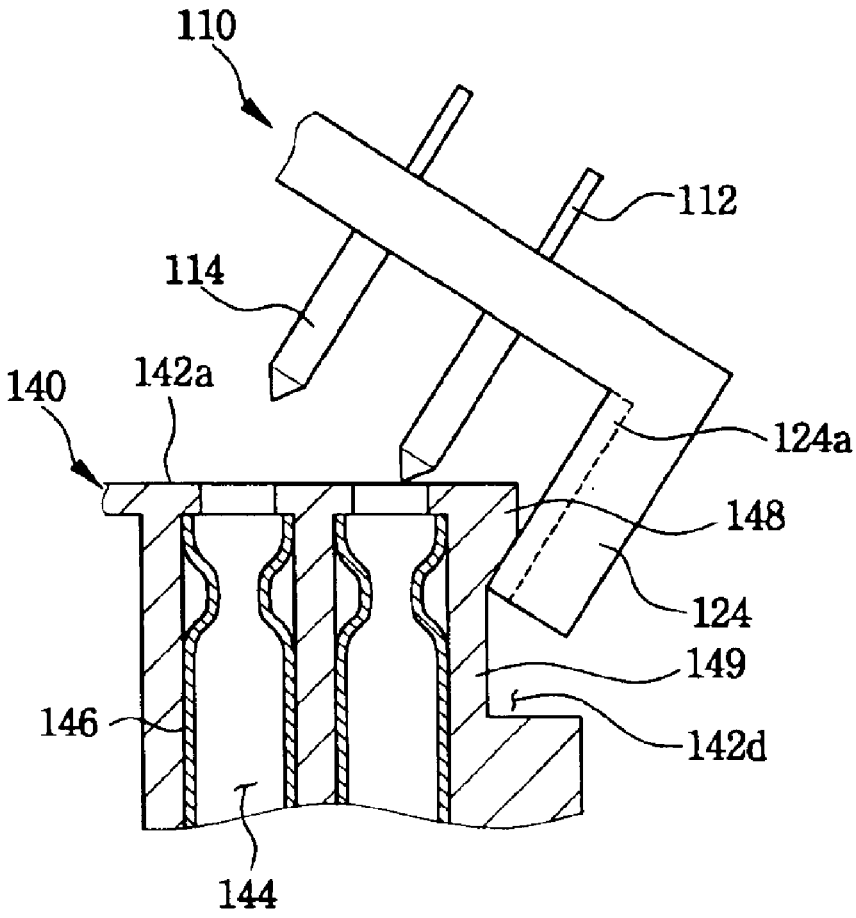
FIG. 4 is a partial cross-sectional view of the connector in FIG. 1A.

The warpage preventing protrusions 148 are each protruded at a predetermined area of the guide step 149. In this embodiment, the warpage preventing protrusion 148 is extended at an end portion of the guide step 149 in a direction substantially perpendicular to the surface of the guide step 149. The warpage preventing protrusion 148 has a length and width both smaller than those of the guide step 149. The warpage preventing protrusion 148 has a wedge shape having a top surface smaller than its bottom surface, as shown in FIGS. 3 and 4. The warpage preventing protrusion 148 has the width such that the warpage preventing protrusion 148 is slidely inserted into the guide groove 124*a* of the guide body 124 at the time of combining the first and second connection parts 110, 140.

In the concavely stepped portion of the receiving body 142, a void space 142*d* is provided on the guide step 149 and between the warpage preventing protrusion 148 and the stepped side of the receiving body 142. To provide the void space 142*d*, the warpage preventing protrusion 148 has a length smaller than that of the guide groove 124*a* of the guide body 124. When the first connection part 110 is rotated to be detached from the second connection part 140, the rotation radius of the first connection part 110 is effectively reduced owing to the void space 142*d*. In other words, the warpage preventing protrusion 148 supports the guide body 124 while the end portion of the guide body 124 is placed in the void space 142*d*. As a result, the connection pins 114 (especially, those disposed at area close to the rotating guide body) are prevented from being warped or bent at the time of rotating the first connection part 110 to be separated from the second connection part 140.

Figure 5:
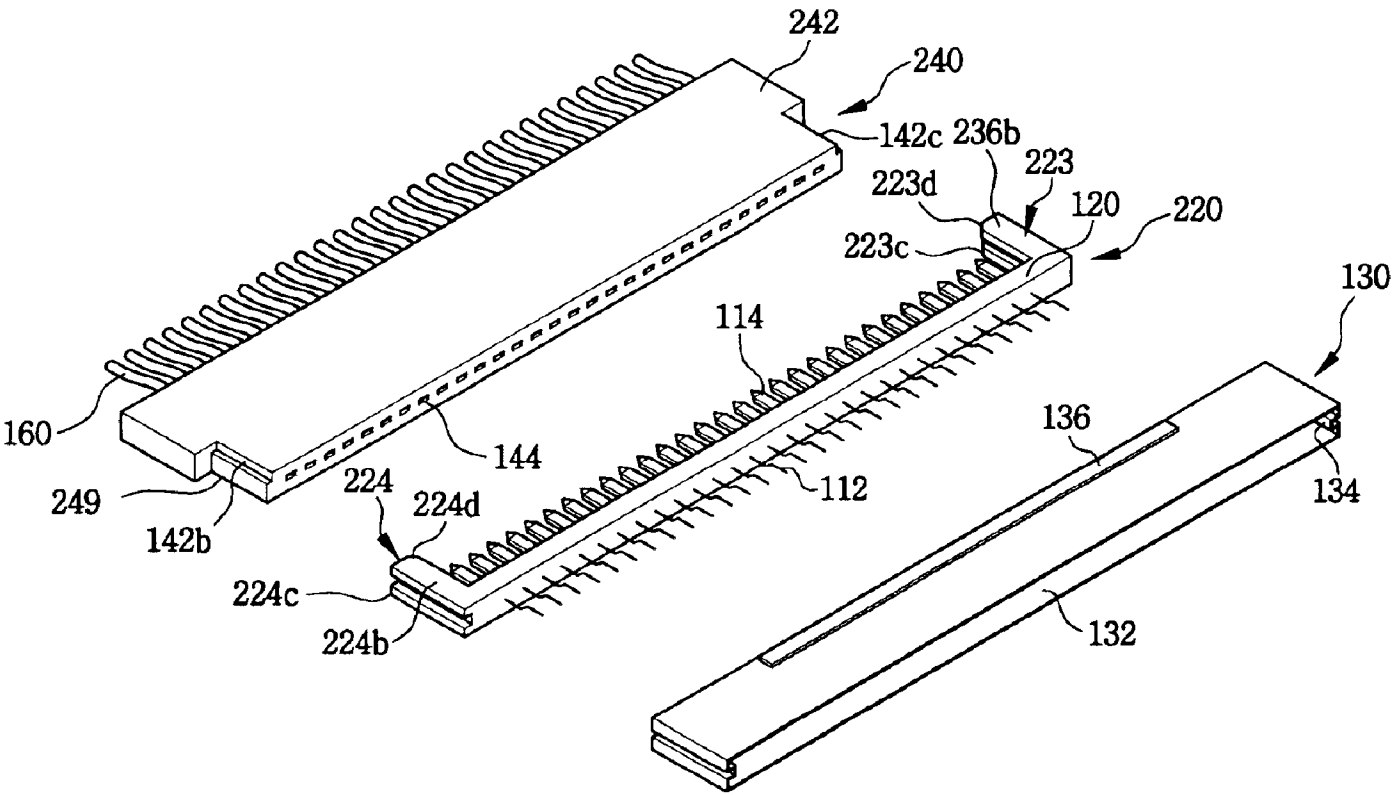
FIG. 5 is an exploded perspective view illustrating a connector according to another exemplary embodiment of the present invention.
Figure 6:
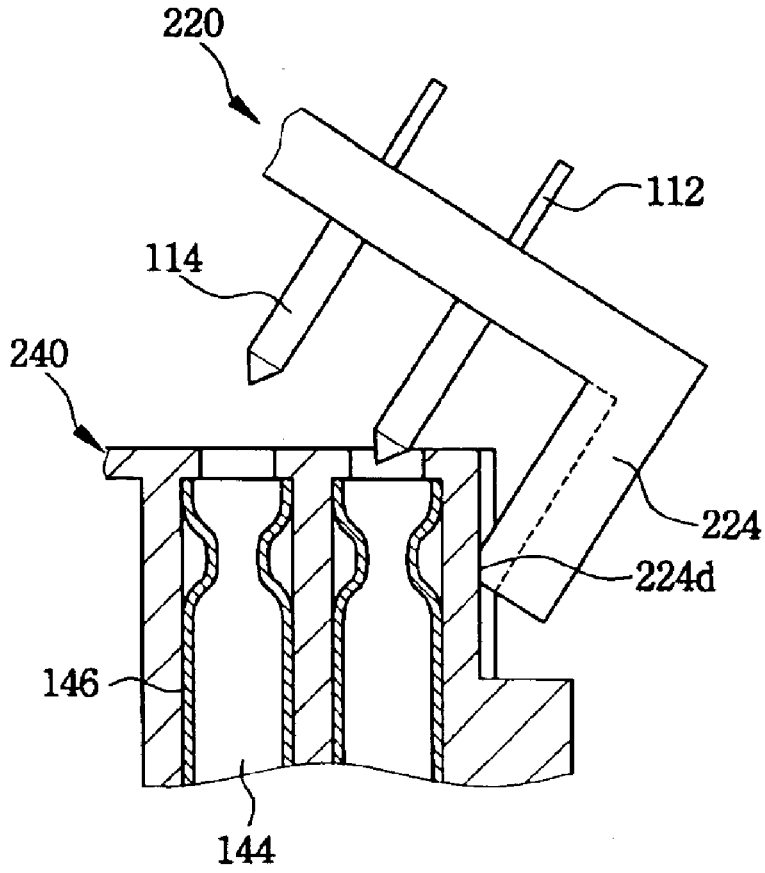
FIG. 6 is a partial cross-sectional view the connector in FIG. 5.

FIG. 5 is an exploded perspective view illustrating a connector according to another exemplary embodiment of the present invention, and FIG. 6 is a partial cross-section view of the connector in FIG. 5. In FIGS. 5 and 6, the same parts as those shown in FIGS. 1A to 4 are represented with like reference numerals and to avoid description duplication, accordingly, their explanation will be omitted.

Referring to FIG. 5, the first connection part 220 includes first and second guide bodies 223, 224 having first and second chamfers 223*d*, 224*d*, respectively. The chamfers 223*d*, 224*d* are each formed at a corner of the corresponding guide body where the inner face of the guide body meets with the edge of the guide body. The chamfers 223*d*, 224*d* each have, for example, a flat surface or a rounded surface.

The second connection part 240 includes a receiving body 242 having the side faces 142*b*, 142*c*. A guide step 249 is formed on each of the side faces 142*b*, 142*c*. In this embodiment, the guide step 249 has the substantially same structure as that in FIGS. 1A–4, except that no warpage preventing protrusion (148 in FIGS. 1A and 3) is formed on the guide step 249.

As shown in FIG. 6, when the first connection part 220 rotates to be detached from the second connection part 240, the surface of each chamfer 224*d* is in contact with the corresponding side face of the second connection part 240. Thus, the rotation radius of the first connection part 220 is decreased owing to the chamfers in contact with the side faces of the second connection part 240. As a result, the connection pins 114 are prevented from being warped or bent.

Figure 7:
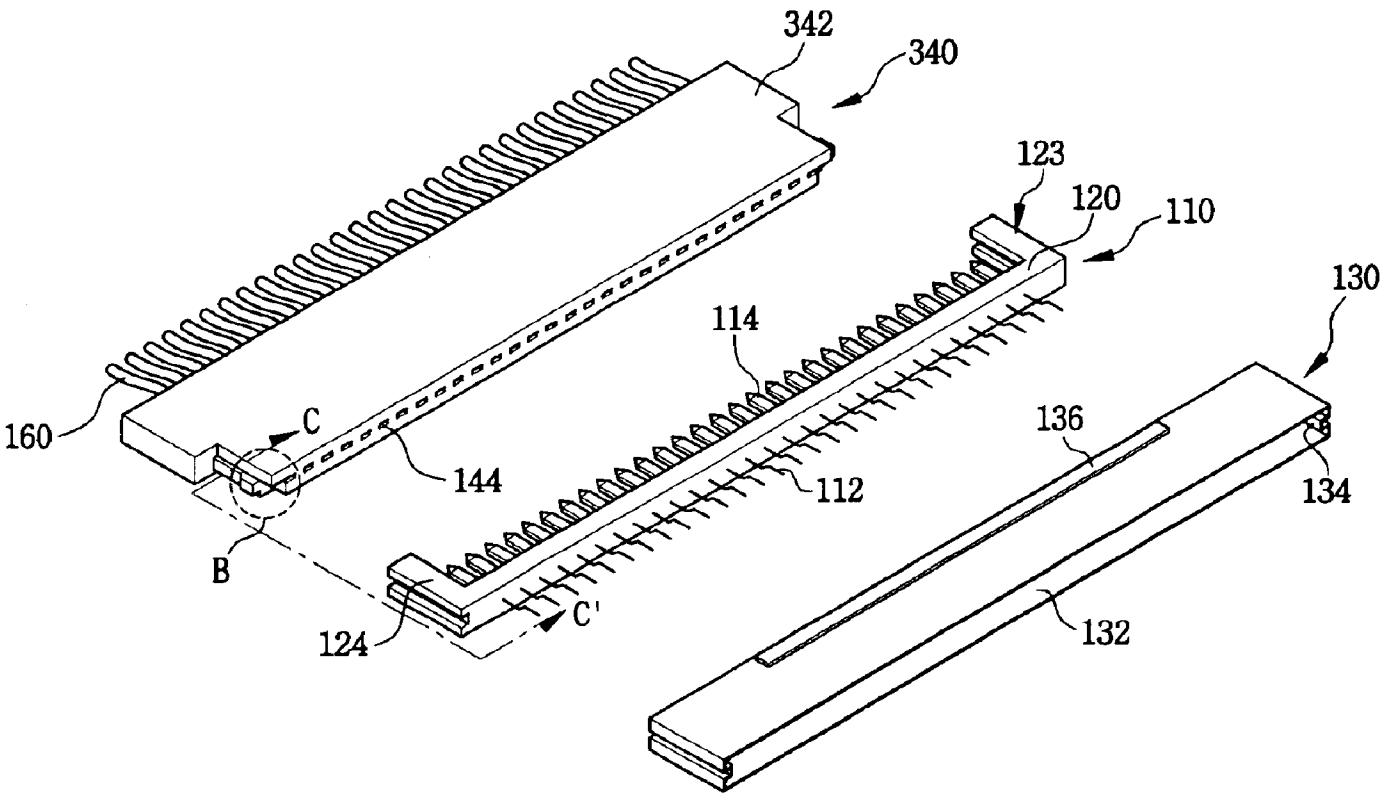
FIG. 7 is an exploded perspective view illustrating a connector according to another exemplary embodiment of the present invention.
Figure 8:
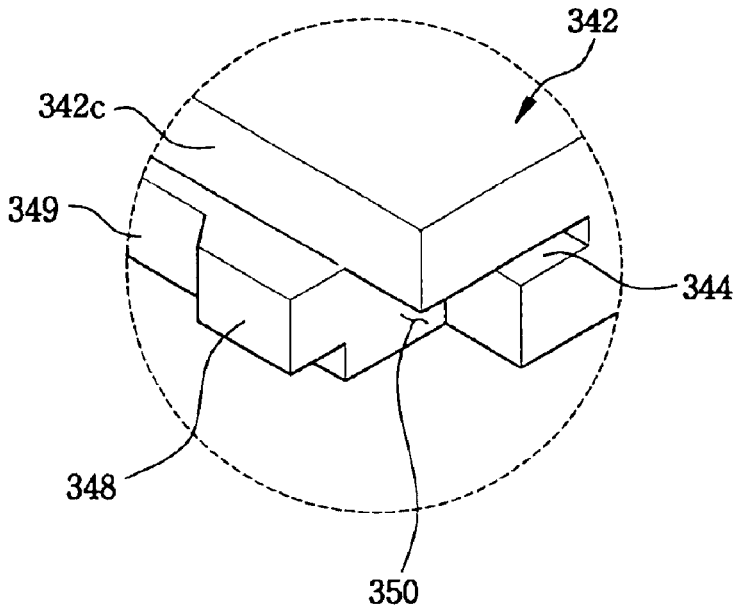
FIG. 8 is an enlarged view of portion 'B' in FIG. 7.
Figure 9:
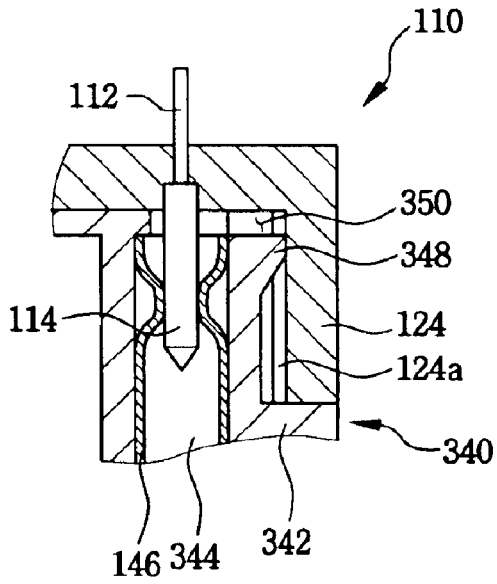
FIG. 9 is a partial cross-sectional view of the connector taken along line C–C' in FIG. 7.

FIG. 7 is an exploded perspective view illustrating a connector according to another exemplary embodiment of the present invention. FIG. 8 is an enlarged view of portion 'B' in FIG. 7. FIG. 9 is a partial cross-sectional view of the connector taken along line C–C' in FIG. 7. In FIGS. 7–9, the same parts as those shown in FIGS. 1A to 6 are represented with like reference numerals and to avoid description duplication, accordingly, their explanation will be omitted.

Referring to FIG. 7, the connector in this embodiment includes a first connection part 110 substantially identical to the first connection part in FIG. 1A and a second connection part 340 having a modification from the second connection part in FIGS. 1A and 3. As shown in FIGS. 8 and 9, the second connection part 340 includes a receiving body 342 having side faces at its both sides. Each side face 342*c* has a predetermined length and width.

On the side face 342*c*, formed is a guide step 349 that has a length smaller than that of the side face 342*c*. A warpage preventing protrusion 348 is formed on the guide step 349 at its end portion. The warpage preventing protrusion 348 is extended from the end portion of the guide step 349, which is adjacent to the front face of the receiving body 342, in a direction substantially perpendicular to the surface of the guide step 349. The warpage preventing protrusion 348 has a predetermined height and a wedge shape with smaller top surface and larger bottom surface.

Figure 10:
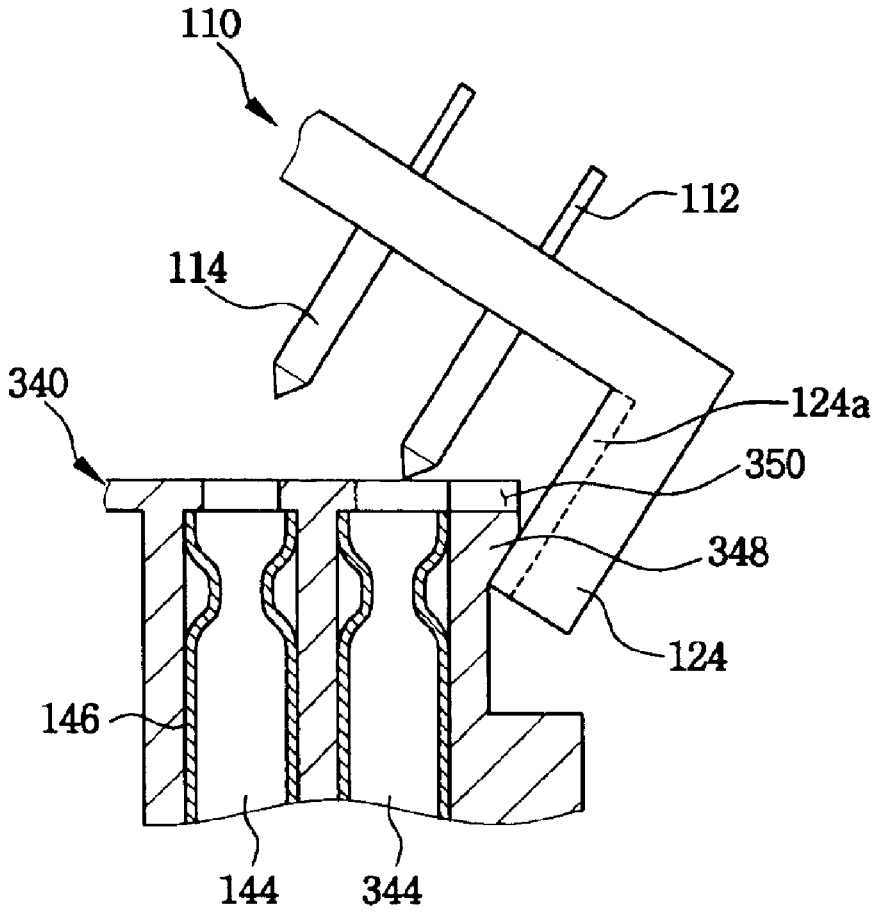
FIG. 10 is a partial cross-sectional view of the connector in FIG. 7.

In this embodiment, the receiving body 342 also has a warpage preventing opening 350 formed at a corner where the side face 342*c*, the front face and the guide step 349 meet each other. The warpage preventing opening 350 is extended from a connection slot 344 adjacent to the side face 342*c*. As shown in FIGS. 8 and 9, the warpage preventing opening 350 is a void space formed at the corner of the receiving body 342 and extended to the adjacent connection slot 344. When the first connection part 110 is rotated to be detached from the second connection part 340, the connection pin 114 inserted in the connection slot 344 adjacent to the warpage preventing opening 350 is moved into the void space from the connection slot 344 as shown in FIG. 10. As a result, the connection pin 114 (in addition to other adjacent connection pins) is prevented from being warped or bent.

Figure 11:
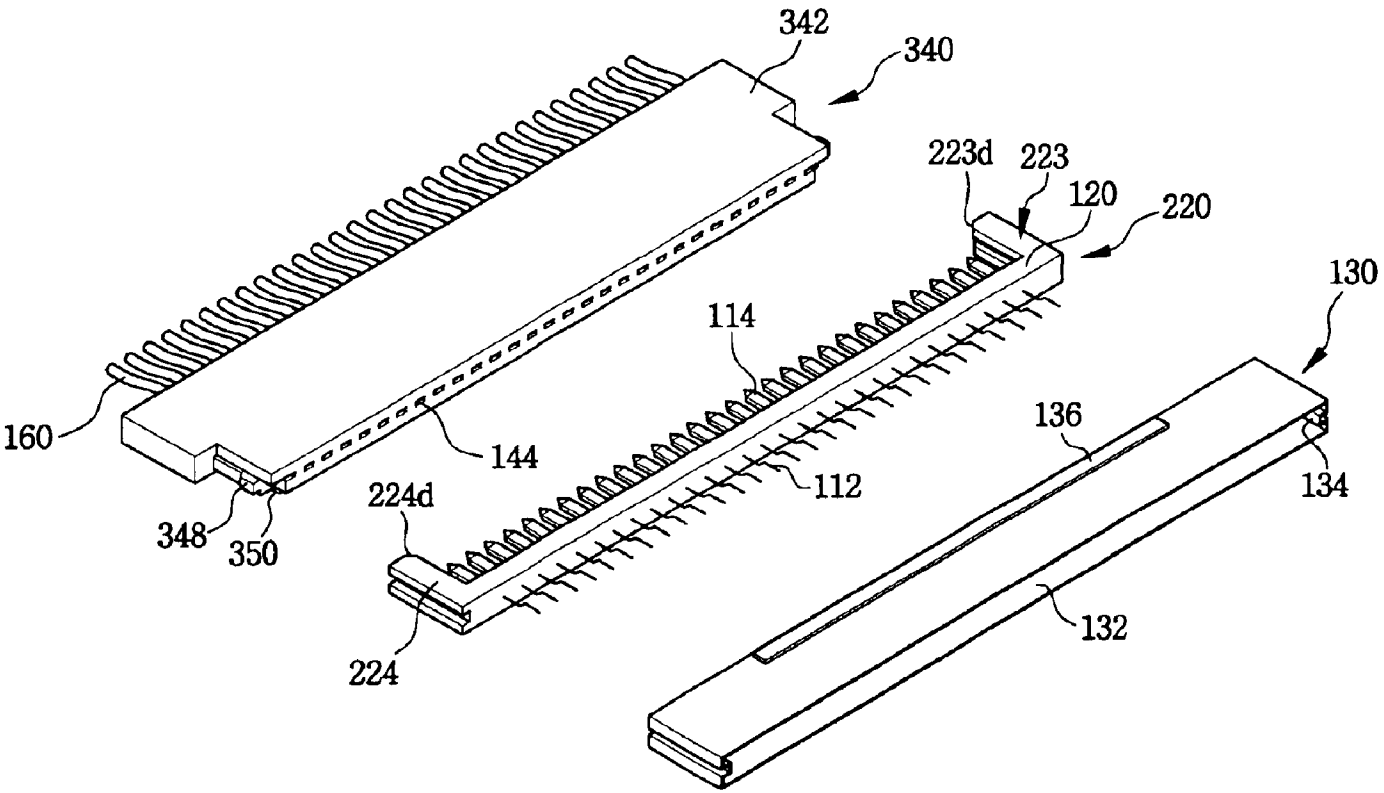
FIG. 11 is an exploded perspective view illustrating a connector according to another exemplary embodiment of the present invention.

FIG. 11 is an exploded perspective view illustrating a connector according to another exemplary embodiment of the present invention. The connector in this embodiment includes a first connection part 220 having the substantially same structure as that of FIG. 5 and a second connection part 340 having the substantially same structure as that of FIG. 7. In FIG. 11, the same parts as those shown in FIGS. 5 and 7 are represented with like reference numerals and to avoid description duplication, accordingly, their explanation will be omitted.

Figure 12:
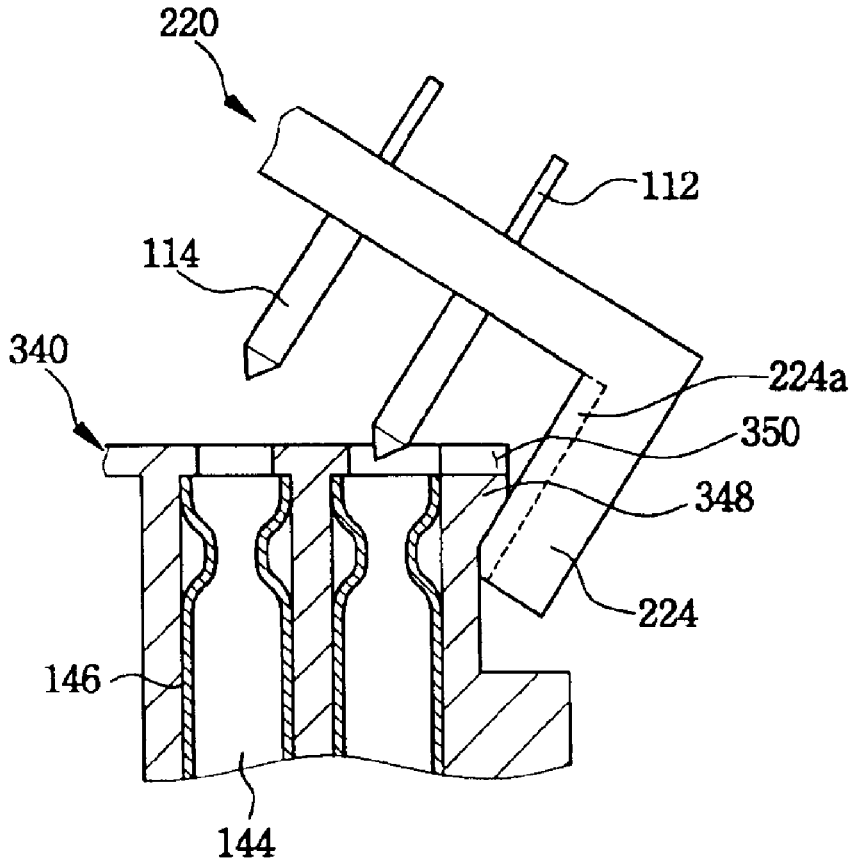
FIG. 12 is a partial cross-sectional view of the connector in FIG. 11.

Referring to FIG. 11, the first connection part 220 includes the first and second guide bodies 223, 224 each having the chamfer 223*d*, 224*d*, and the second connection part 340 includes the warpage preventing protrusion 348 and the warpage preventing opening 350 at the corner of both the end portions of the receiving body 342. As described in detail above, the warpage preventing protrusion 348 is slidably disposed in the guide groove 224*a* of the first connection part 220, when the first and second connection parts 220, 340 are combined together. When the first connection part 220 is rotated to be detached from the second connection part 340, the chamfer of the first connection part 220 becomes in contact with the side face of the second connection part 340 while the warpage preventing protrusion 348 supports the guide body of the first connection part 220 as shown in FIG. 12. At the same time, the connection pin 114 adjacent to the side face is moved into the warpage preventing opening 350 extended from the adjacent connection slot. Owing to the chamfers 223*d*, 224*d* and the warpage preventing protrusions and openings 348, 350 equipped in the connector, the rotation radius of the rotating guide body of the first connection part is effectively reduced so that the connection pins 114 are prevented from being warped or bent.

Figure 13:
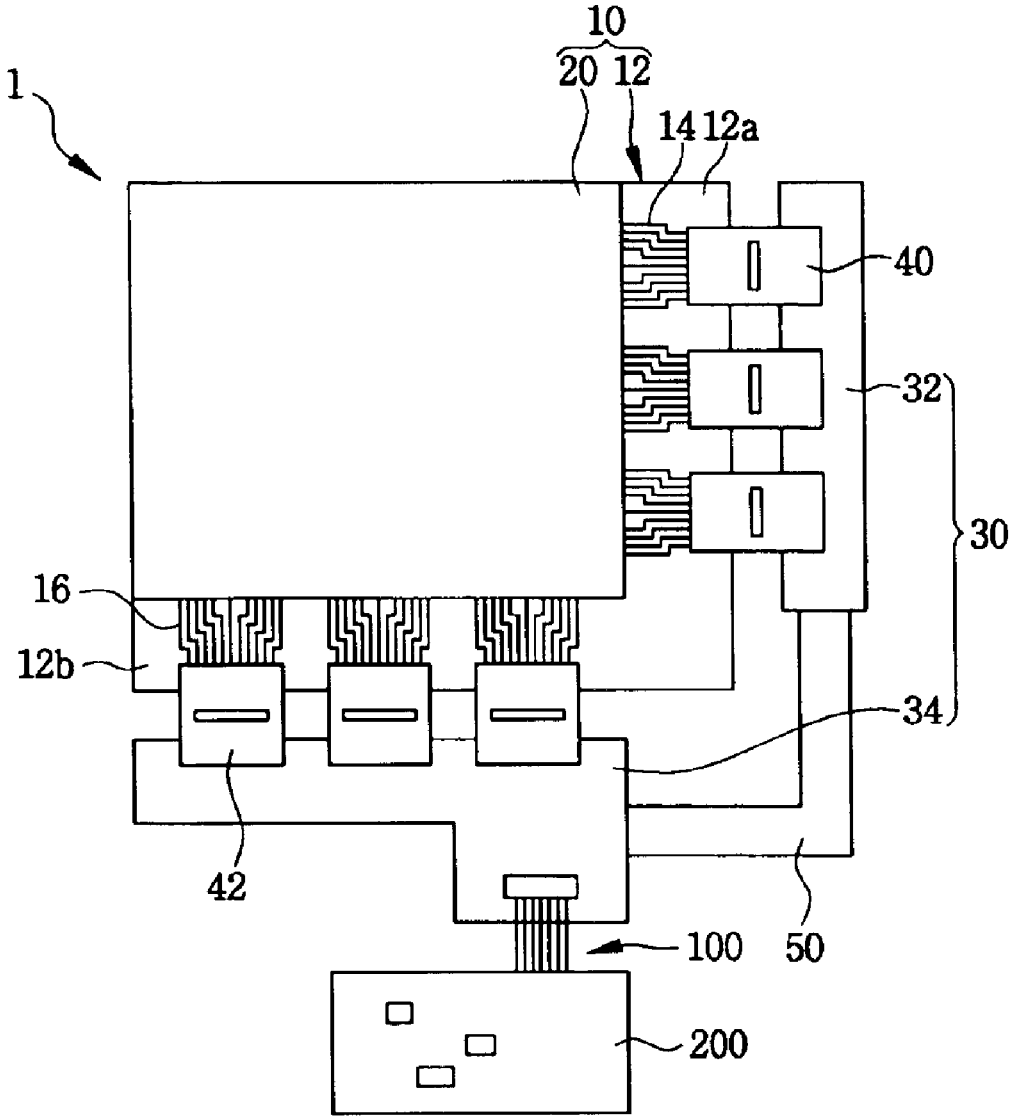
FIG. 13 is a schematic view illustrating a liquid crystal display device according to an embodiment of the present invention.

FIG. 13 is a schematic view illustrating a liquid crystal display (LCD) device having the connector according to one of the above embodiments. The LCD device 1 includes an LCD panel 10, a printed circuit board (PCB) 30, a driving module and a back light assembly (not shown). The driving module includes a tape carrier package (TCP) 40. The back light assembly provides light to the LCD panel 10. The LCD panel 10 includes a thin film transistor (TFT) substrate 12, a color filter substrate 20 and a liquid crystal layer (not shown). The liquid crystal layer is interposed between the thin film transistor substrate 12 and the color filter substrate 20.

Gate lines 14 and data lines 16 are disposed on the thin film transistor substrate 12. The gate lines 14 are extended in a first direction, and the data lines 16 are disposed in a second direction that is substantially perpendicular to the first direction. A gate connection pad (not shown) is formed at an end of each of the gate lines 14. A data connection pad (not shown) is formed at an end of each of the data lines 16.

The color filter substrate 20 is smaller than the thin film transistor substrate 12. The color filter substrate 20 is assembled with the thin film transistor substrate 12 such that the gate connection pad and the data connection pad are exposed.

For convenience, a region where the gate lines 14 are exposed from the color filter substrate 20 is referred to as a gate region 12*a*, and a region where the data lines 16 are exposed from the color filter substrate 20 is referred to as a source region 12*b*. The printed circuit board 30 includes a gate printed circuit board 32 and a source printed circuit board 34. The gate printed circuit board 32 is electrically connected to the gate region 12*a* of the LCD panel 10 via the tape carrier package (TCP) 40. The source printed circuit board 34 is electrically connected to the source region 12*b* of the LCD panel 10 via the tape carrier package (TCP) 42. A flexible circuit board 50 connects the gate printed circuit board 32 and the source printed circuit board 34. The flexible circuit board 50 transfers a driving signal outputted from the source printed circuit board 34 to the gate printed circuit board 32.

The LCD device 1 is electrically connected to a main board 200. The main board 200 generates electric signals for driving the LCD device 1. The connector 100, one of the above embodiments, is disposed between the LCD device 1 and the main board 200 to provide electrical connection therebetween. The connector 100 includes a first connection part (one of the above described embodiments) electrically connected to the gate printed circuit board 32 or to the source printed circuit board 34 by soldering, a second connection part (one of the above described embodiments) electrically connected to the first connection part and the mail board 200.

The LCD device 1 may include a transmissive type LCD panel or a transmissive and reflective type LCD panel. In this case, the LCD device 1 includes a back light assembly that is disposed under the LCD panel 10. The back light assembly provides the light to the liquid crystal display panel 10. The LCD device 1 may further include optical sheets. The optical sheets may be interposed between the LCD panel 10 and the back light assembly. The optical sheets enhance luminance of the light generated from the back light assembly. The optical sheets also make the luminance have a uniform distribution.

The LCD device 1 may further include a receiving container and a chassis. The receiving container receives the LCD panel 10 and the back light assembly. The chassis is combined with the receiving container to securely contain the LCD device parts therein.

Having described preferred embodiments of the connector and an image display device employing the connector according to the present invention, modifications and variations can be readily made by those skilled in the art in light of the above teachings. It is therefore to be understood that, within the scope of the appended claims, the present invention can be practiced in a manner other than as specifically described herein.

What is claimed is:

1. A connector for electrically connecting first data lines to second data lines, comprising:

a first connection part including:

a plurality of connection pins electrically connected with the first data lines;

a supporting body that holds the connection pins; and a guide body extended from a first longitudinal end of the supporting body in a direction substantially perpendicular to a longitudinal direction of the supporting body, the guide body having a guide groove formed at an inner face of the guide body; and a second connection part including:

a plurality of connection slots that receive the connection pins to provide electrical connection between the first data lines and the second data lines, the connection slots each having an entrance hole at a front face of the second connection part;

a side face extended from the front face an a direction substantially perpendicular to a longitudinal direction of the front face;

a guide step formed on the side face to be inserted into the guide groove; and a warpage preventing protrusion formed on the guide step to provide a recess portion at a selected region of the guide step to prevent the connection pins from being bent at the time of detaching the first connection part from the second connection part.

2. The connector of claim 1, wherein the connection slots each include a connection terminal that electrically connects a corresponding connection pin to a corresponding second data line, the connection terminal having a fixing portion for securely gripping the connection pin.

3. The connector of claim 1, wherein the side face has a width larger than a width of the guide step.

4. The connector of claim 3, wherein a widthwise center of the guide step is offset from a widthwise center of the side face.

5. The connector of claim 1, further including a cover that receives the first connection part, the cover including a connection member formed at a side face of the cover to be in contact with the guide body when the first connection part is received in the cover.

6. The connector of claim 5, wherein the guide body further includes a connection groove formed at an outer surface of the guide body, the connection member being placed in the connection groove when the cover receives the first connection part.

7. The connector of claim 1, wherein the guide body has a chamfer formed at an inner corner of an edge opposite to the supporting body.

8. The connector of claim 7, wherein the chamfer is in contact with the side face and the guide step when the first connection part is rotated to be detached from the second connection part.

9. The connector of claim 1, wherein the second connection part further includes a warpage preventing opening formed at a corner at which the side face, the front face and the guide step meet each other, the warpage preventing opening being extended from a connection slot adjacent to the side face.

10. The connector of claim 9, wherein the warpage preventing opening forms a void space into which corresponding one of the connection pins is moved from the connection slot adjacent to the side face.

11. The connector of claim 1, wherein the guide body includes:

a first guide body portion to be in contact with the side face when the first and second connection parts are combined; and a second guide body portion to be in contact with the guide step when the first and second connection parts are combined, wherein the first and second guide body portions form side walls of the guide groove.

12. The connector of claim 11, wherein the first guide body portion has a width larger than a width of the second guide body portion.

13. The connector of claim 12, wherein a difference between the widths of the first and second guide body portions is substantially same as a height of the guide step.

14. The connector of claim 1, wherein the warpage preventing protrusion is protruded at an end portion of the guide step adjacent to the front face, the warpage preventing protrusion being placed in the guide groove to support the guide body when the first connection part is rotated to be detached from the second connection part.

15. The connector of claim 14, wherein the warpage preventing protrusion has a length smaller than a length of the guide step.

16. The connector of claim 15, wherein the warpage preventing protrusion has a width smaller than a width of the guide step.

17. The connector of claim 14, wherein the warpage preventing protrusion has a wedge shape of which top surface is smaller than a bottom surface.

18. The connector of claim 1, wherein the first connection part further includes:

a second guide body extended from a second longitudinal end of the supporting body in a direction substantially perpendicular to the longitudinal direction of the supporting body, the second guide body having a second guide groove formed at an inner face of the second guide body.

19. The connector of claim 18, wherein the second connection part further includes:

a second guide step formed on a second side face opposite to the side face, the second guide step being inserted into the second guide groove; and a second warpage preventing protrusion formed on the second guide step to prevent the connection pins from being bent.

20. The connector of claim 19, wherein the side face has a length different from a length of the second side face.

21. The connector of claim 20, wherein the guide body has a length different from a length of the second guide body.

22. The connector of claim 21, wherein the lengths of the side face and the guide body are substantially identical to each other, and the lengths of the second side face and the second guide body are substantially identical to each other.

23. The connector of claim 1, wherein the guide step has a length substantially identical to a length of the guide body.

24. A connector for electrically connecting first data lines to second data lines, comprising:

a first connection part including:

a plurality of connection pins electrically connected with the first data lines;

a supporting body that holds the connection pins;

a guide body extended from a first longitudinal end of the supporting body in a direction substantially perpendicular to a longitudinal direction of the supporting body, the guide body having a guide groove formed at an inner face of the guide body; and a chamfer formed at an inner corner of an edge of the guide body opposite to the supporting body; and a second connection part including:

a plurality of connection slots that receive the connection pins to provide electrical connection between the first data lines and the second data lines, the connection slots each having an entrance hole at a front face of the second connection part;

a side face extended from the front face in a direction substantially perpendicular to a longitudinal direction of the front face; and a guide step formed on the side face to be inserted into the guide groove, the guide step having a front surface adjacent to the front face of the second connection part, the front surface and the front face being coplanar, wherein the chamfer is in contact with the side face when the first connection part is rotated to be detached from the second connection part.

25. The connector of claim 24, further including:

a warpage preventing protrusion formed on the guide step to prevent the connection pins from being bent at the time of detaching the first connection part from the second connection part; and a warpage preventing opening formed at a corner at which the side face, the front face and the guide step meet each other, the warpage preventing opening being extended from a connection slot adjacent to the side face.

26. The connector of claim 25, wherein the warpage preventing protrusion is protruded at an end portion of the guide step adjacent to the front face, the warpage preventing protrusion being placed in the guide groove to support the guide body when the first connection part is rotated to be detached from the second connection part.

27. A liquid crystal display device comprising:

a liquid crystal display panel that processes image data signals to display images by controlling liquid crystal disposed in the liquid crystal display panel;

a driving module that provides the liquid crystal display panel with driving signals to control the liquid crystal in the liquid crystal display panel; and a connector that provides electrical connection between the driving module and an external device, the connector comprising:

a first connection part including:

a plurality of connection pins electrically connected with the driving module;

a supporting body that holds the connection pins; and a guide body extended from a first longitudinal end of the supporting body in a direction substantially perpendicular to a longitudinal direction of the supporting body, the guide body having a guide groove formed at an inner face of the guide body; and a second connection part including:

a plurality of connection slots that receive the connection pins to provide electrical connection between the connection pins and the external device, the connection slots each having an entrance hole at a front face of the second connection part;

a side face extended from the front face in a direction substantially perpendicular to a longitudinal direction of the front face;

a guide step formed on the side face to be inserted into the guide groove; and a warpage preventing protrusion formed on the guide step to provide a recess portion at a selected region of the guide step to prevent the connection pins from being bent at the time of detaching the first connection part from the second connection part.

28. The liquid crystal display device of claim 27, wherein the guide body of the first connection part includes a chamfer formed at an inner corner of an edge of the guide body, the edge being opposite to the supporting body, the chamfer being in contact with the side face and the guide step when the first connection part is rotated to be detached from the second connection part.

29. The liquid crystal display device of claim 27, wherein the second connection part further includes a warpage preventing opening formed at a corner at which the side face, the front face and the guide step meet each other, the warpage preventing opening being extended from a connection slot adjacent to the side face.

30. The liquid crystal display device of claim 29, wherein the warpage preventing opening forms a void space into which corresponding one of the connection pins is moved from the connection slot adjacent to the side face.

31. A connector for electrically connecting first data lines to second data lines, comprising:

a first connection part including:

a plurality of connection pins electrically connected with the first data lines;

a supporting body that holds the connection pins; and a guide body integrally formed with the supporting body and extended from a first longitudinal end of the supporting body in a direction substantially perpendicular to a longitudinal direction of the supporting body, the guide body having a guide groove formed at an inner face of the guide body; and a second connection part including:

a plurality of connection slots that receive the connection pins to provide electrical connection between the first data lines and the second data lines, the connection slots each having an entrance hole at a front face of the second connection part;

a side face extended from the front face in a direction substantially perpendicular to a longitudinal direction of the front face;

a guide step formed on the side face to be inserted into the guide groove; and a warpage preventing protrusion formed on the guide step to prevent the connection pins from being bent at the time of detaching the first connection part from the second connection part, wherein the guide step and the warpage preventing protrusion are integrally formed with the side face, wherein the guide step having a front surface adjacent to the front face of the second connection part, the front surface and the front face being coplanar.

32. The connector of claim 31, wherein the second connection part further includes a warpage preventing opening formed at a corner at which the side face, the front face and the guide step meet each other, the warpage preventing opening being extended from a connection slot adjacent to the side face.

33. The connector of claim 32, wherein the warpage preventing opening forms a void space into which corresponding one of the connection pins is moved from the connection slot adjacent to the side face.

34. The connector of claim 31, wherein the guide body includes:

a first guide body portion to be in contact with the side face when the first and second connection parts are combined; and a second guide body portion to be in contact with the guide step when the first and second connection parts are combined, wherein the first and second guide body portions form side walls of the guide groove.

35. The connector of claim 34, wherein the first guide body portion has a width larger than a width of the second guide body portion.

36. The connector of claim 35, wherein a difference between the widths of the first and second guide body portions is substantially same as a height of the guide step.

37. The connector of claim 31, wherein the warpage preventing protrusion is protruded at an end portion of the guide step adjacent to the front face, the warpage preventing protrusion being placed in the guide groove to support the guide body when the first connection part is rotated to be detached from the second connection part.

38. The connector of claim 37, wherein the warpage preventing protrusion has a length smaller than a length of the guide step.

39. The connector of claim 38, wherein the warpage preventing protrusion has a width smaller than a width of the guide step.

40. The connector of claim 37, wherein the warpage preventing protrusion has a wedge shape of which top surface is smaller than a bottom surface.

41. A connector for electrically connecting first data lines to second data lines, comprising:

a first connection part including:

a plurality of connection pins electrically connected with the first data lines;

a supporting body that holds the connection pins; and a guide body extended from a first longitudinal end of the supporting body in a direction substantially perpendicular to a longitudinal direction of the supporting body, the guide body having a guide groove formed at an inner face of the guide body; and a second connection part including:

a plurality of connection slots that receive the connection pins to provide electrical connection between the first data lines and the second data lines, the connection slots each having an entrance hole at a front face of the second connection part;

a side face extended from the front face in a direction substantially perpendicular to a longitudinal direction of the front face;

a guide step formed on the side face to be inserted into the guide groove; and a warpage preventing opening formed at a corner at which the side face, the front face and the guide step meet each other, the warpage preventing opening being extended from a connection slot adjacent to the side face.

* * * * *